US006601529B1

(12) United States Patent
Karafiath

(10) Patent No.: US 6,601,529 B1
(45) Date of Patent: Aug. 5, 2003

(54) STABILIZED TUMBLEHOME HULL FORM

(75) Inventor: Gabor Karafiath, Silver Spring, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/888,633

(22) Filed: Jun. 21, 2001

(51) Int. Cl.[7] ..... B63B 3/00
(52) U.S. Cl. ..... 114/65 R; 114/283; 114/288
(58) Field of Search ..... 114/61.11, 61.1, 114/61.22, 123, 271, 283, 288

(56) References Cited

U.S. PATENT DOCUMENTS

| | | | |
|---|---|---|---|
| 4,172,426 | A | 10/1979 | Susman |
| 4,337,543 | A | 7/1982 | Van Ulzen |
| 5,417,597 | A | 5/1995 | Levedahl |

FOREIGN PATENT DOCUMENTS

EP 271939 A1 * 6/1988 ..... B63B/1/12

OTHER PUBLICATIONS

Daniel F. Carney, "The Shape of Ships to Come," *Popular Science*, Sep. 2001, magazine cover page, p 3 and pp 42–46.

Joseph Antenucci et al., "Division Teams with U.K. to Develop Data Acquisition System for Novel Hullform," *Wavelenghts*,http://www.dt.navy.mil/pao/excerpts%20 pages/2000/divukJuly.html, 5 pages (attached copy printed out Oct. 30, 2001).

Jim Wilson, "Sea Power 2000," *Popular Mechanics website*, http://popularmechanics.com/science/military/1999/11/ sea_power_, 2000/print.phtml, 6 pages (attached copy printed out Oct. 30, 2001.

David Caskey et al., "U.S. Joining U.K. in Test of Innovative Ship: Triton,", *Surface Warfare*, Jul./Aug. 2001, pp 26–28 (p 26 slightly cut off in attached copy).

* cited by examiner

*Primary Examiner*—Jesus D. Sotelo
(74) *Attorney, Agent, or Firm*—Howard Kaiser

(57) ABSTRACT

A marine vessel which uniquely combines tumblehome-like and trimaran-like attributes in an integrative form describing two underside channels comprises a medial major hull and a pair of lateral minor hulls. The port and starboard minor hulls, each generally describing an inverted triangular cross-section, have respective outside surfaces which slope in tumblehome fashion (downwardly outwardly). The major hull has port and starboard outside surfaces which can slope in any fashion, whether tumblehome or nontumblehome. The outside surfaces of the minor hulls are parallel to the vessel's centerline, whereas the outside surfaces of the major hull aftwardly slant toward the centerline. The minor hulls' respective outside surfaces and the major hull's outside surfaces generally converge at longitudinally equivalent port and starboard locations, at which locations the major hull's outside surfaces commence to forwardly slant toward the centerline so as to generally converge at the vessel's bow tip.

19 Claims, 14 Drawing Sheets

STABILIZED TUMBLEHOME HULL FORM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to marine and naval engineering and architecture as pertains to shapes and configurations of ships, boats and other water vessels, more particularly to hull forms of such vessels.

The term "tumblehome" (alternatively spelled "tumble home" or "tumble-home") refers to a property of a water vessel's hull wherein its topside, or some portion thereof, is inclined inward. Generally according to conventional tumblehome-type monohull designs, the two sides of the vessel are sloped, above the maximum beam (widest width or breadth), toward the middle or center of the vessel. These known monohull tumblehome hull designs typically are beset with certain undesirable characteristics. They have a poor righting arm, since the tumblehome feature decreases the water plane area as the ship heels (tilts to one side; lists). They have poor damage stability, because the above-water volume is limited by the tumblehome feature. They have restricted useable superstructure volume and width at the deck level. They are characterized by unusual sea-keeping responsiveness along with ongoing concern regarding the dynamic stability in a seafaring way; this is probably attributable to the broad transom (which has large above-water volume associated therewith) in combination with the wave-piercing bow (which has limited above-water volume associated therewith).

To some extent, trimarans are intended to reduce or eliminate the stability problems associated with conventional monohull tumblehome designs. A trimaran configuration includes three separate hulls, usually a main hull and two much smaller, pontoon-like or float-like hulls (sometimes called "outriggers") on each side. A main drawback of a typical trimaran design relates to the fact that the large separation distance between the main hull and the outer hull amplifies the bending moment. Hence, each cross-structure connecting the main hull to an outer hull (outrigger) must be strong enough to handle the large bending moments caused by hydrodynamic loads. Consequently, the cross-structures represent significant increases in structural weight.

SUMMARY OF THE INVENTION

In view of the foregoing, it is an object of the present invention to provide a tumblehome-type hullform which is more stable than conventional tumblehome-type hull forms.

It is a further object of the present invention to provide a tumblehome-type hullform which is characterized by greater internal volume than is typical conventional tumblehome-type hull forms.

It is another object of the present invention to provide a tumblehome-type hullform which has better sea-keeping characteristics than is typical of tumblehome-type hull forms.

It is a further object of the present invention to provide a tumblehome-type hullform which is more stable than conventional tumblehome-type hullforms, but which is lighter than conventional trimaran hullforms.

Typically according to the present invention, a water vehicle such as a water transportation vehicle has a length, an imaginary lengthwise axis, a port side and a starboard side. The vehicle is about equivalently configured on each of its sides. The vehicle comprises a tumblehome outer surface, an inner surface and a junctional surface. The inner surface generally is located more proximate the lengthwise axis than the tumblehome outer surface. The junctional surface joins each of the tumblehome outer surface and the inner surface so as to generally be interposed between the tumblehome outer surface and the inner surface.

In accordance with many embodiments of the present invention, a hull comprises a back- section and a front section. The hull is characterized by a length and by an imaginary horizontal plane passing therethrough. The back section includes a pair of lateral fins and a medial portion between the lateral fins. The medial portion includes a pair of medial faces. Each fin includes a lateral tumblehome face and a crosswise face. Each crosswise face at least substantially is sloped at a smaller angle with respect to the imaginary horizontal plane than are the medial faces and the lateral tumblehome faces. Each crosswise face and a lateral tumblehome face form an at least substantially horizontal fin edge. Each crosswise face and a medial face form an at least substantially horizontal junctional corner. Each crosswise face at least substantially is sloped at an angle with respect to the imaginary horizontal plane which, to at least a substantial degree, gradually increases in accordance with the forward lengthwise direction of the hull.

In accordance with the present invention, the medial faces can be sloped in a tumblehome or conventional (nontumblehome) fashion. According to some of the embodiments wherein the medial faces are sloped in tumblehome fashion, the medial tumblehome faces and the lateral tumblehome faces at least substantially are sloped at at least substantially the same at least substantially constant angle with respect to the imaginary horizontal plane.

A typical hull configuration according to this invention has an imaginary centerline and comprises a stern surface, an outer starboard tumblehome surface, an inner starboard surface, an outer port tumblehome surface, an inner port surface, a starboard obliquely downfacing surface and a port obliquely downfacing surface. The outer starboard tumblehome surface, the inner starboard surface, the outer port tumblehome surface, the inner port surface, the starboard obliquely downfacing surface and the port obliquely downfacing surface each extend from the stern surface in a generally forward direction. The starboard obliquely downfacing surface connects the outer starboard tumblehome surface and the inner starboard surface. The port obliquely downfacing surface connects the outer port tumblehome surface and the inner port surface. The outer starboard tumblehome surface and the outer port tumblehome surface are each approximately parallel to the centerline. Proceeding from the stern surface in a generally forward direction, the inner starboard surface tumblehome and the inner port surface diverge from the centerline in approximately equivalent fashion.

The inner starboard surface and the inner port surface are each disposed: (i) vertically (i.e., in nontumblehome fashion); or, (ii) nonvertically, equivalently and oppositely angled upwardly away from the centerline (i.e., in nontumblehome fashion); or, (iii) nonvertically, equivalentsly and oppositely angled upwardly toward the centerline (i.e., in tumblehome fashion). According to some embodiments wherein the inner surfaces are tumblehome surfaces, the outer starboard tumblehome surface, the inner starboard tumblehome surface, the outer port tumblehome surface and the inner port tumblehome surface each define approximately the same tumblehome angle. Generally, according to inventive embodiments wherein the inner surfaces, as welt as the outer surfaces, are tumblehome surfaces, the outer starboard tumblehome surface, the starboard obliquely downfacing surface and the inner starboard tumblehome surface define, from an aft perspective, an approximate N-shaped starboard profile wherein the outer starboard tumblehome surface reaches a greater elevation than does the inner starboard tumblehome surface; the outer port tumblehome surface, the port obliquely downfacing surface and the inner port tumblehome surface define, from an aft perspective, an approximate reverse N-shaped port profile wherein the outer port tumblehome surface reaches a greater elevation than does the inner port tumblehome surface. Proceeding from the stern surface in a generally forward direction, the N-shaped starboard profile and the reverse N-shaped port profile each narrow in breadth in approximately equivalent fashion.

The present invention uniquely features a dual (both-sided) tumblehome, trimaran-like, integral hullform design. According to typical inventive embodiments, the inventive hullform includes a medial hull and two outrigger-analogue hulls which are integrally associated with the medial hull. According to typical inventive practice, there are no cross-structures for connecting the outrigger-analogue hulls to the medial hull; all three hulls are closely integrated into what is essentially a monohull hullform. According to many inventive embodiments, the inventive hullform is characterized by two tumblehome surfaces (one port, one starboard); one tumblehome surface is described by each outrigger-analogue hull, and two nontumblehome surfaces are described by the medial hull. According to other inventive embodiments, the inventive hullform is characterized by four tumblehome surfaces (two port, two starboard); two tumblehome surfaces are described by the medial hull, and one tumblehome surface is described by each outrigger-analogue hull.

The inventive dual tumblehome monohull hullform affords greater sea-keeping, stability and capacity (space or volume) vis-a-vis the conventional tumblehome monohull vessel, while also affording lesser structural weight vis-a-vis the conventional trimaran vessel. In comparison with conventional hulls, the inventive hull features a relatively moderate transom width; effectively in certain respects, the inventive hull's transom width is the width of the transom at the rear of the inventive medial hull. Stability and seakeeping are furthered by the inventive vessel's combination of the two lateral outrigger-analogue hulls and the medial hull characterized by a moderate transom width. The double (two-sided) tumblehome arrangement, on both sides of the inventive vessel, serves not only to reduce signatures but also to architecturally render, together with an upper portion of the medial hull, a kind of curtain over two mirror-image tunnels extending forward from the transom. The inventive hullform lends itself to application to a variety of types and sizes of vessels (ships, boats, etc.) and to association with a variety of types and sites of propulsion means. Depending on the inventive embodiment, the vessel's topside can be "open" or "closed."

As compared with a conventional tumblehome monohull vessel, the tumblehome monohull vessel according to the present invention has superior characteristics, especially in terms of stability, internal volume and sea-keeping. The tumblehome monohull vessel according to the present invention also has superior characteristics as compared with a conventional trimaran vessel, especially in terms of structural weight. In terms of stability and sea-keeping, when the inventively configured vessel heels it advantageously acts to attain additional water plane area and additional righting force. In terms of internal volume, the inventively configured vessel inherently advantageously provides additional space by virtue of its structurally augmentative quality.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
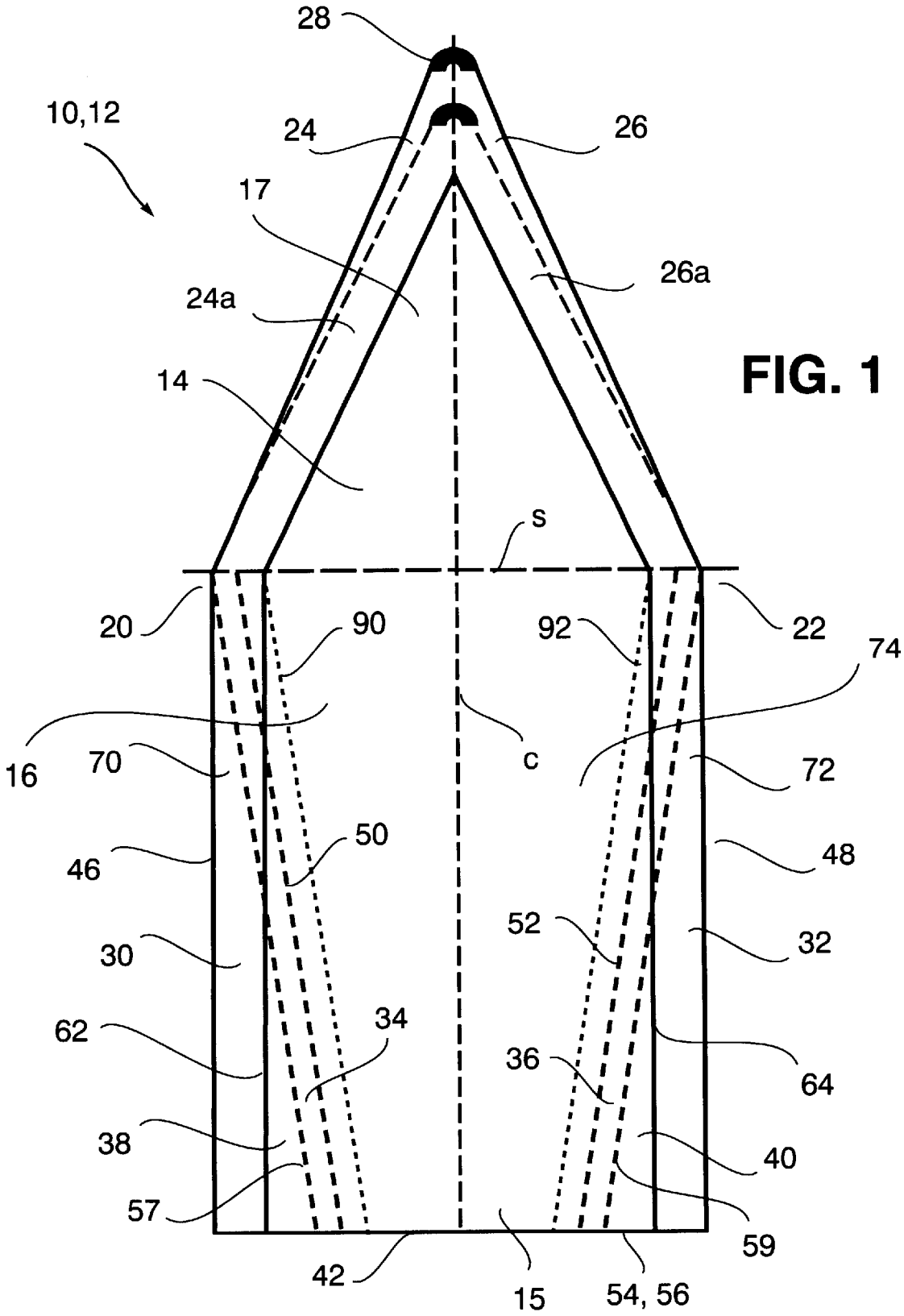
FIG. 1 is a diagrammatic top plan view, partially broken away to show concealed detail, of a representative embodiment of a hullform in accordance with the present invention, wherein the hullform is characterized by a substantially flat hull bottom.
Figure 2:
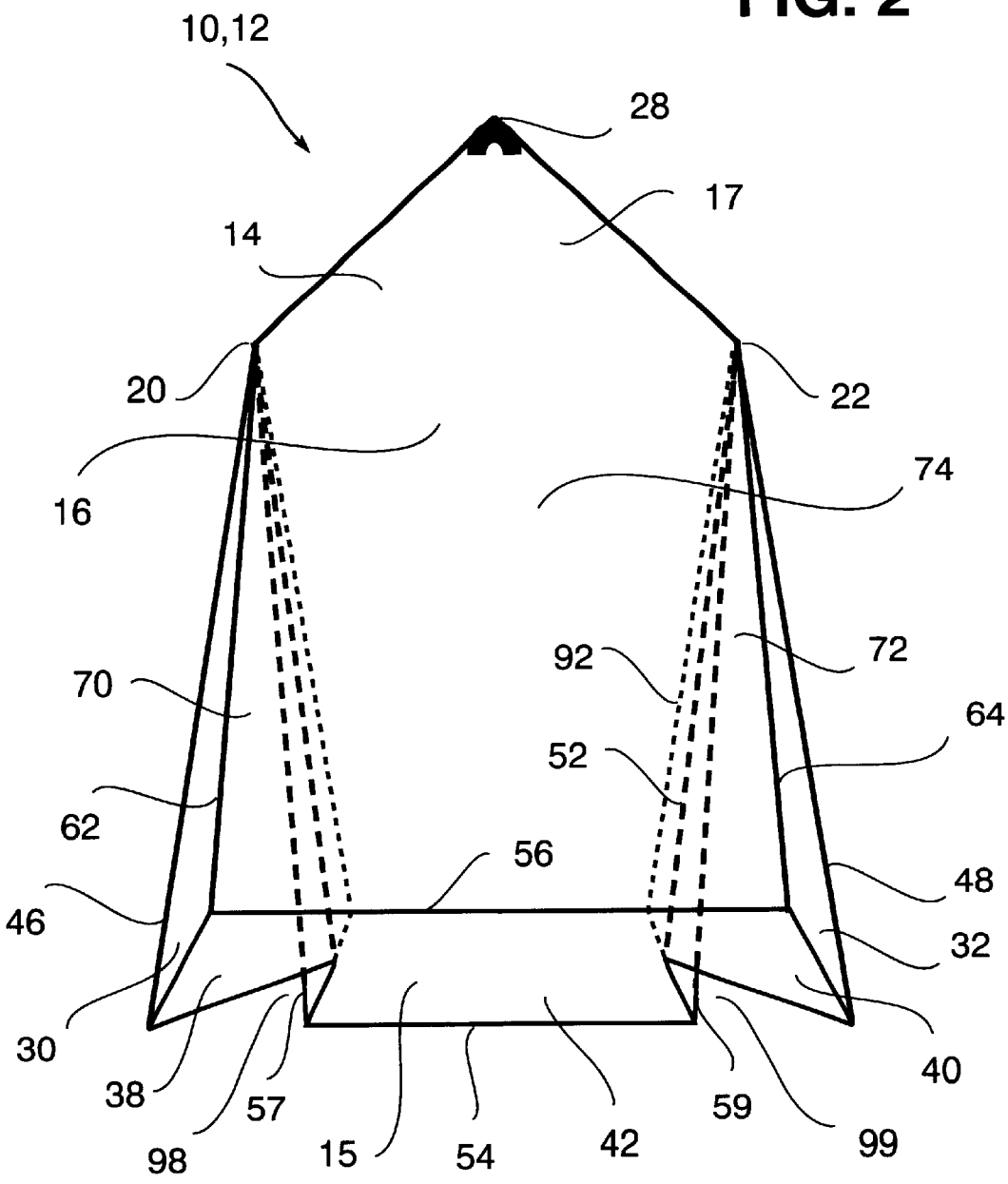
FIG. 2 is a diagrammatic top rear perspective view, partially broken a away to show concealed detail, of the inventive hullform embodiment shown in FIG. 1.
Figure 3:
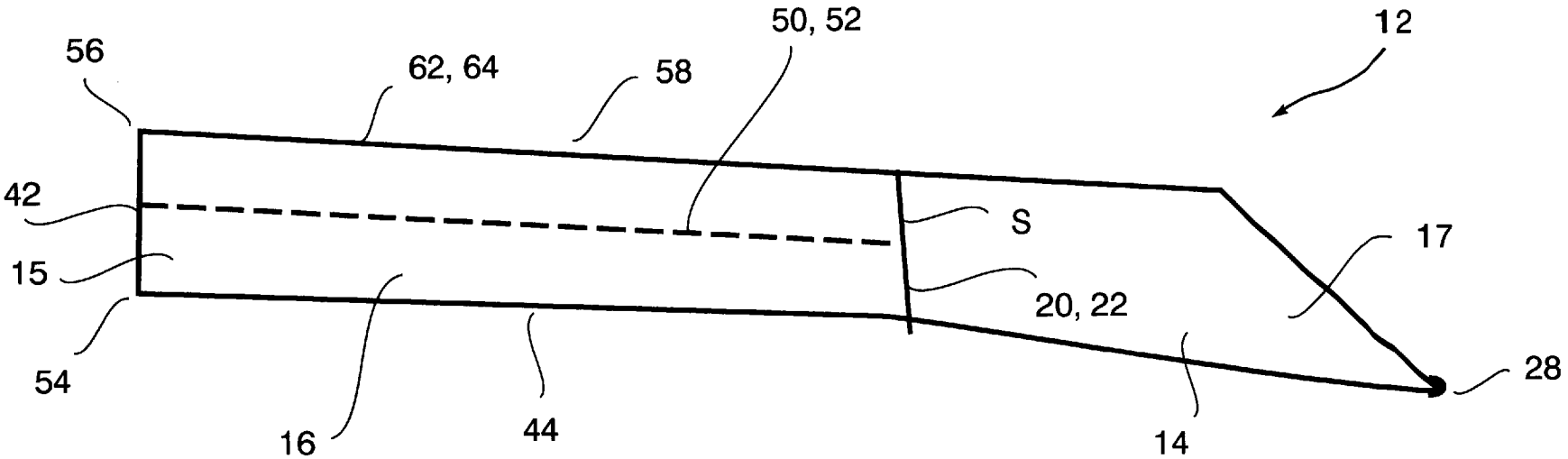
FIG. 3 is a diagrammatic side elevation view, partially in section, of the inventive hullform embodiment shown in FIG. 1.

Referring now to the figures generally, marine vessel 10 includes a hull 12 which is inventively characterized by a double tumblehome configuration on each of its port (left-hand) and starboard (right-hand) sides. The views of FIG. 1 through FIG. 3 are at least partially "transparent" to better show the inventive configuration. Generally in these figures, unbroken (e.g., dotted or dashed) lines are for geometric illustrative purposes or to represent configurational aspects which would not be seen when viewing a real ("opaque") hull 12 from the perspective shown; solid (unbroken) lines represent visible details when viewing such hull 12 from the perspective shown.

As shown in FIG. 1, from an upper planwise perspective, hull 12 approximately describes a pentagonal outline. Hull 12 can be considered to be approximately divided into two sections—viz., a front (bow-inclusive) section 14 and a back (stern-inclusive) section 16—by an imaginary vertical plane which passes through the linear demarcation therebetween as indicated by dashed line s in FIG. 1 and FIG. 3. Peripherally speaking, front section 14 approximately describes a triangle; back section 16 approximately describes a rectangle. The inventive double tumblehome configurations are relegated to back section 16, extending from stern 15 to the "break" points 20 and 22 on port and starboard sides, respectively, of hull 12—that is, from a top plan perspective, the location at which the hull 12 side begins to narrow.

Figure 4:
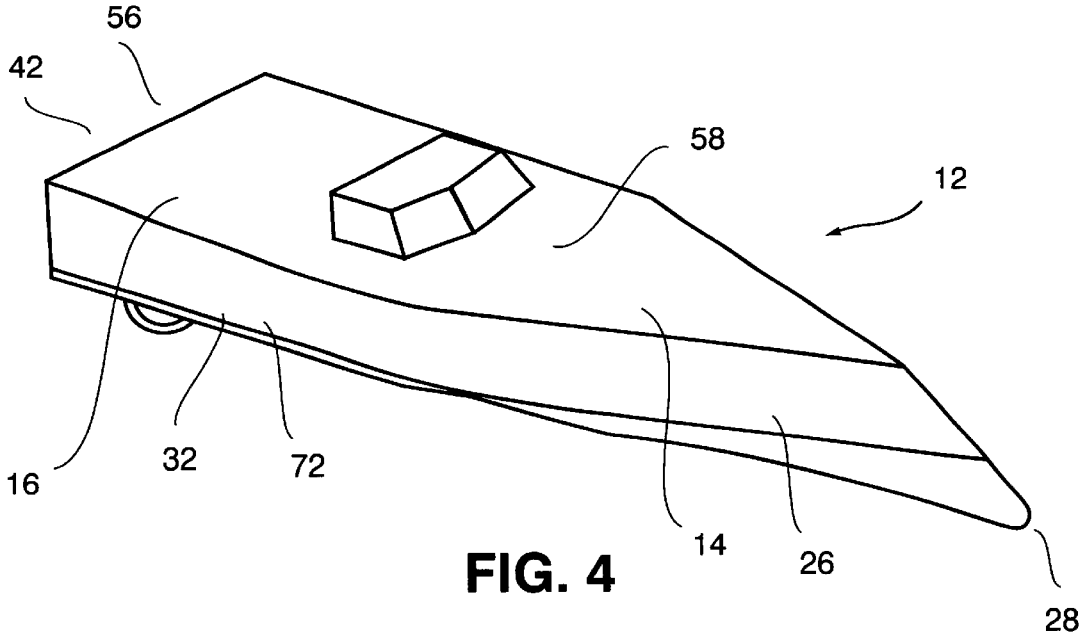
FIG. 4 is a diagrammatic top, side and front perspective view of an inventive hull form embodiment such as shown in FIG. 1.

As especially shown in FIG. 1 and FIG. 4, front section 14 has a front port tumblehome surface 24 and a front starboard tumblehome surface 26 which (typically according to the present invention) are at least substantially planar and which converge in bow 17 at the hull's front tip 28. The front tumblehome surfaces 24 and 26 are disposed at equal but opposite angles with respect to an imaginary vertical plane which axially longitudinally bisects hull 12, such planar bisector passing through the linear demarcation indicated by dashed line (centerline) c in FIG. 1 and FIG. 3. Front tumblehome surfaces 24 and 26 are shown to gradually increase in vertical breadth (height-width) toward tip 28. According to other inventive embodiments, such as shown by front tumblehome surfaces 24*a* and 26*a*, the front tumblehome surfaces maintain a constant vertical breadth.

Particularly with reference to FIG. 1 and FIG. 2, back section 16 has a port outer tumblehome surface 30, a starboard outer tumblehome surface 32, a port inner tumblehome surface 34, a starboard inner tumblehome surface 36, a port connective surface 38, a starboard connective surface 40, a stern 15 rectilinear transom surface 42 and an undersurface 44. According to typical inventive embodiments, back section 16 surfaces 30, 32, 34, 36, 38, 40, 42 and 44 are, at least to a substantial degree, geometrically planar (flat). The inner tumblehome surfaces and the connective surfaces define a pair of tunnels or channels. Port inner tumblehome surface 34 and port connective surface 38 together describe channel 98. Starboard inner tumblehome surface 36 and starboard connective surface 40 together describe channel 99.

Certain back section 16 surfaces join each other along certain edges and corners. Port outer tumblehome surface 30 and port connective surface 38 adjoin at port lower outer tumblehome edge 46. Starboard outer tumblehome surface 32 and starboard connective surface 40 adjoin at starboard lower outer tumblehome edge 48. Port inner tumblehome surface 34 and port connective surface 38 adjoin at port tumblehome corner 50. Starboard inner tumblehome surface 36 and starboard connective surface 40 adjoin at starboard tumblehome corner 52. Transom surface 42 and under surface 44 adjoin at lower transom edge 54. Port inner tumblehome surface 34 and under surface 44 adjoin at port lower inner tumblehome edge 57. Starboard inner tumblehome surface 36 and under surface 44 adjoin at starboard lower inner tumblehome edge 59.

Figure 5:
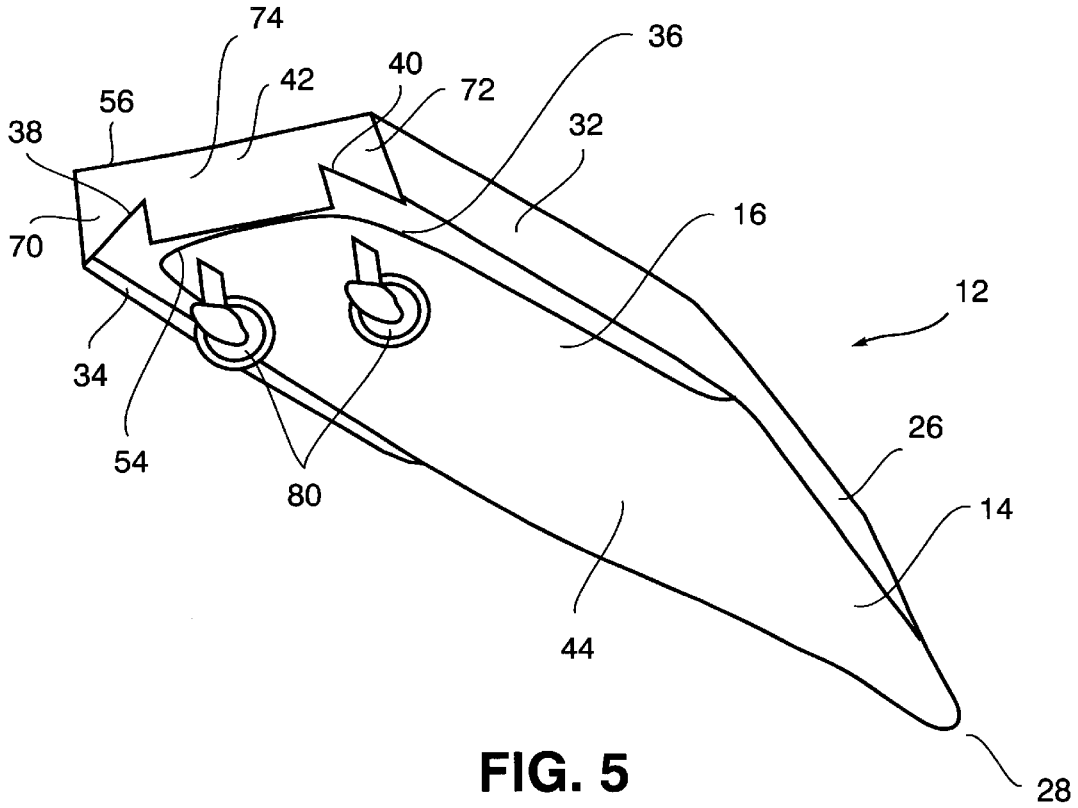
FIG. 5 is a diagrammatic bottom, side and rear perspective view of an inventive hullform embodiment such as shown in FIG. 1.

Transom 42 also has upper transom edge 56. As shown in FIG. 4 and FIG. 5, hull 12 is characterized by being "closed" on its top side, and includes above surface 58. Transom surface 42 and above surface 58 adjoin at upper transom edge 56. Port outer tumblehome surface 30 and above surface 58 adjoin at port upper tumblehome edge 62. Starboard outer tumblehome surface 32 and above surface 58 adjoin at starboard upper tumblehome edge 64. According to many inventive embodiments, hull 12 is characterized by being "open" on its top side. Regardless of whether hull 12 has a closed or open configuration when viewed from above, the essential features of the present invention can be effectuated.

Furthermore, the present invention can be practiced in association with practically any kind of propulsion means. For instance, depicted in FIG. 4 and FIG. 5 near stern 15 are two contrarotating tractor pod propulsors 80 which are characterized by reduced cavitation. Each propulsor 80 includes a contrarotating tractor propeller and an azimuthing pod.

Figure 6:
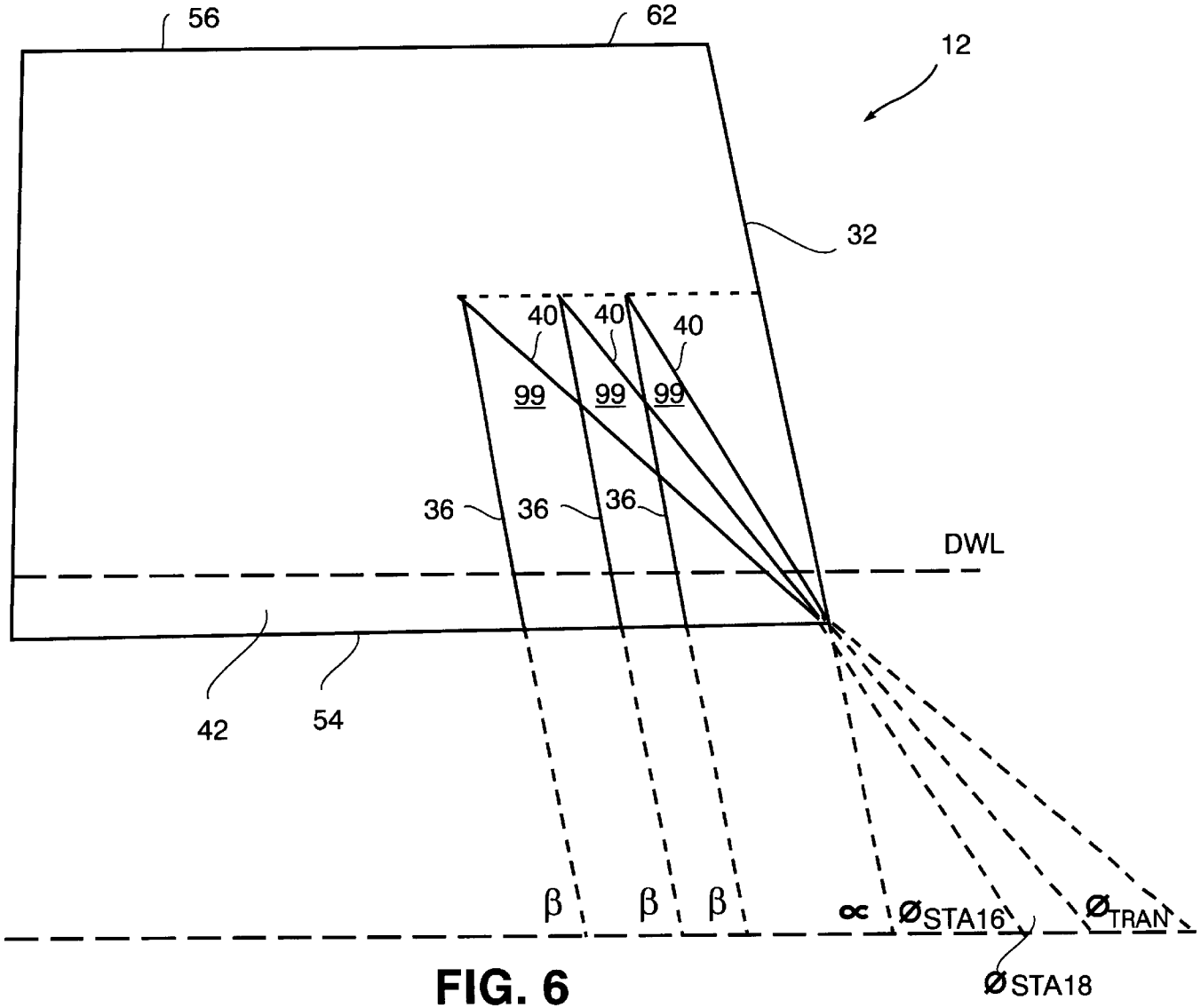
FIG. 6 is a diagrammatic, partial (starboard half), rear elevation view of an inventive hullform embodiment which is similar to that shown in FIG. 1, wherein the hullform is characterized by a substantially flat hull bottom.
Figure 7:
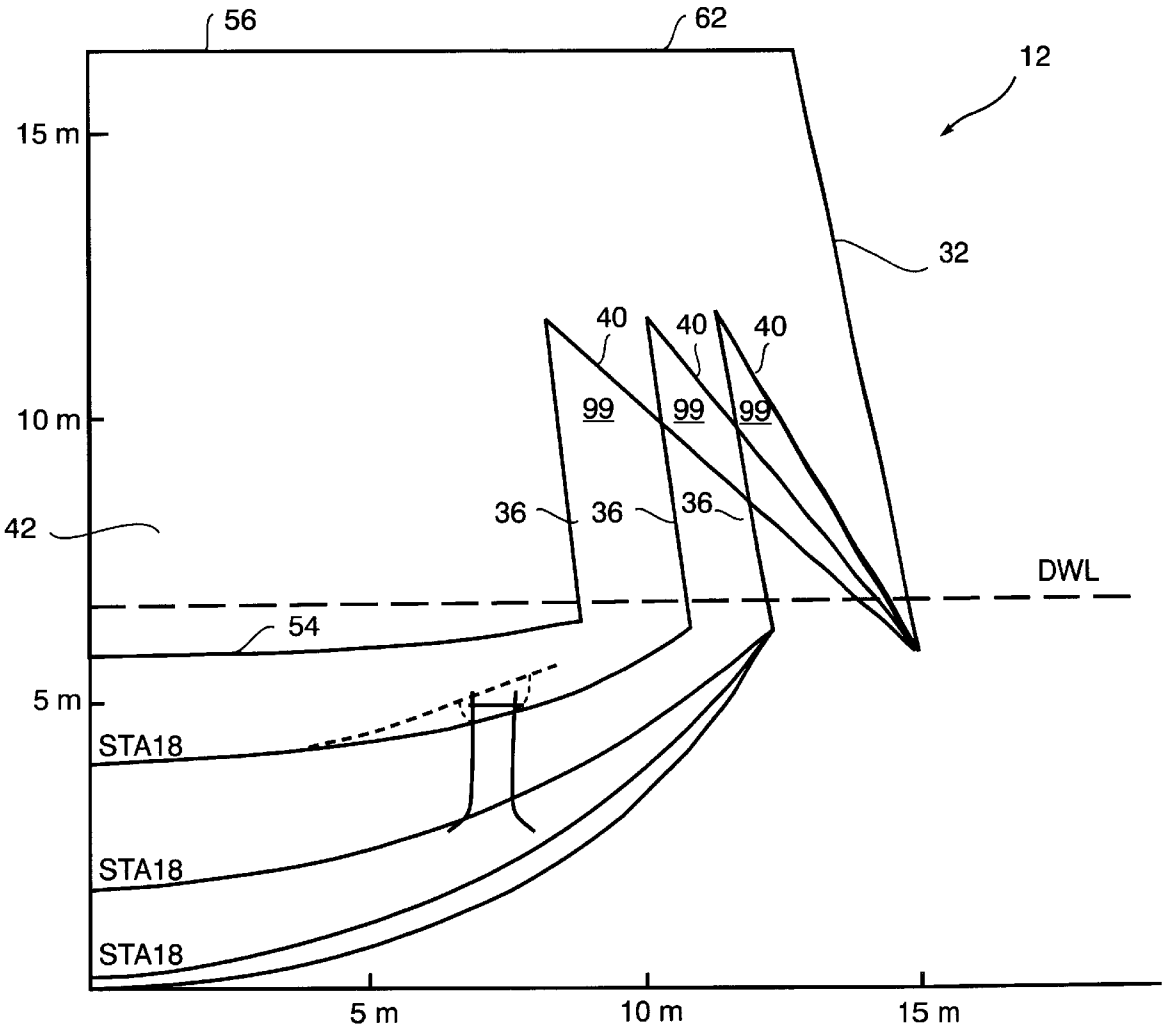
FIG. 7 is a diagrammatic view, similar to the view shown in FIG. 6, of another inventive hullform embodiment which is similar to that shown in FIG. 1, wherein the hullform is characterized by a substantially curved hull bottom.

As best illustrated in FIG. 3, FIG. 6 and FIG. 7, port and starboard corners 50 and 52 each approximately define a horizontal line which is roughly midway between the horizontal plane approximately defined by above surface 58 (or, the horizontal plane in which upper tumblehome edges 62 and 64 coplanarly lie) and the horizontal plane approximately defined by under surface 44. However, this type of approximate intermediacy of corners 50 and 52 is not necessary according to inventive practice; in terms of vertical distances between horizontally defined planes, corners 50 and 52 can be nearer (or much nearer) to upper tumblehome edges 62 and 64, or can be nearer (or much nearer) to lower inner tumblehome edges 57 and 59.

Overall, hull 12 is symmetrical with respect to the imaginary vertical plane bisector therethrough along dashed line c. It is helpful to describe hull 12 in relation to imaginary lines and planes. In addition to (i) a first imaginary vertical plane traversely intersecting said vessel (along dashed line s) and (ii) a second imaginary vertical plane longitudinally intersecting and bisecting said vessel (along dashed line c), hull 12 conceivably defines (iii) an imaginary horizontal plane (imagined to be passing horizontally therethrough, but not indicated in the drawings).

Imaginary dotted lines 90 and 92, shown in FIG. 1 and FIG. 2, indicate where inner tumblehome surfaces 34 and 36 would meet the above surface 54 if inner tumblehome surfaces 34 and 36 were imagined to be extended. The respective imaginary planes passing through inner tumblehome surfaces 34 and 36 intersect, at dotted lines 90 and 92, respectively, an imaginary horizontal plane passing through above surface 54. Port and starboard dotted lines 90 and 92 generally connect transom 42 to port and starboard "break" points 20 and 22, respectively.

Reference now being made especially to FIG. 6 and FIG. 7, port outer tumblehome surface 30 (not shown in FIG. 6 and FIG. 7) and starboard outer tumblehome surface 32 are approximately equally and oppositely inclined, in tumblehome fashion, at angle $\alpha$ with respect to the imaginary horizontal plane. Port inner tumblehome surface 34 (not shown in FIG. 6 and FIG. 7) and starboard inner tumblehome surface 36 are approximately equally and oppositely inclined, in tumblehome fashion, at angle $\beta$ with respect to the imaginary horizontal plane. Although angle $\alpha$ and angle $\beta$ are shown in the figures to be about equal, it is emphasized that this angular equality is not essential to inventive practice, albeit many inventive embodiments preferably effectuate such angular equality.

Angle $\alpha$ is approximately constant (nonvariable, unchanging) throughout the longitudinal expanse of each of outer tumblehome surfaces 30 and 32. Similarly, angle β is show to be approximately constant (nonvariable, unchanging) throughout the longitudinal expanse of each of inner tumblehome surfaces 34 and 36 but angle β can be variable in accordance with this invention. However, angle ϕ described by each of connective surface 38 and 40 is shown as nonconstant (variable, changing) but angle ϕ can be a constant according to this invention. Port connective surface 38 and starboard connective surface 40 are approximately equally and oppositely inclined at angle ϕ with respect to the imaginary horizontal plane. Angle ϕ of each of connective surfaces 38 and 40 changes in accordance with longitudinal position (i.e., in accordance with distance from transom 42; this angular variability is associated with the parallel orientations of the outer tumblehomes and the oblique orientations of the inner tumblehomes, in relation to longitudinal axis c of hull 12.

Outer tumblehome surfaces 30 and 32 are each approximately parallel with respect to longitudinal axis b and with respect to each other. In contrast, inner tumblehome surfaces 34 and 36 are each nonparallel with respect to longitudinal axis c and with respect to each other. Viewing hull 12 from above, inner tumblehome surfaces 34 and 36 slant approximately equally and oppositely outward, away from longitudinal axis c, as inner tumblehome surfaces 34 and 36 proceed forward from transom 42; otherwise expressed, inner tumblehome surfaces 34 and 36 slant approximately equally and oppositely inward, toward longitudinal axis c, as inner tumblehome surfaces 34 and 36 proceed aftward from transom 42 to the transverse plane delineated by dashed line s.

Angle ϕ of each of connective surfaces 38 and 40 varies as a function of longitudinal distance along axis c. This angular variability is attributable to certain inventive configurational characteristics, viz.: (i) the contradistinction between the parallelness of outer tumblehome surfaces 30 and 32 and the nonparallelness of inner tumblehome surfaces 34 and 36, as best shown in FIG. 1; and, (ii) the approximately horizontal disposition of each of port tumblehome corner 50 and starboard tumblehome corner 52, as best shown in FIG. 3. Thus, angle ϕ of each of connective surfaces 38 and 40 varies as a function of longitudinal distance along axis c. As to each of connective surfaces 38 and 40, the more forward the longitudinal position therealong, the greater the value of angle ϕ; conversely, the more aftward the longitudinal position therealong, the lesser the value of angle ϕ.

With reference to FIG. 6 and FIG. 7, hull 12 can be considered to be (or be part of) a twenty station ship, wherein transom 42 represents station 20. At transom 42, each of connective surfaces 38 and 40 is sloped at an angle $\phi_{TRAN}$. At station 18 (indicated as "STA 18"), which is forward of transom 42, each of connective surfaces 38 and 40 is sloped at an angle $\phi_{STA18}$ which is greater than angle $\phi_{TRAN}$. At station 16 (indicated as "STA 16"), which is forward of station 18, each of connective surfaces 38 and 40 is sloped at an angle $\phi_{STA16}$ which is greater than angle $\phi_{STA18}$. At station 14 (indicated as "STA 14"), which is forward of station 16, each of connective surfaces 38 and 40 is sloped at an angle $\phi_{STA14}$ which is greater than angle $\phi_{STA16}$. This increasing trend of angle ϕ while proceeding forward continues past "midships" (the transverse midline intermediate bow and stern, or the longitudinal "fifty-yard line") until connective surfaces 38 and 40 reach break points 20 and 22, respectively, which are located at approximately station 6 of the twenty station ship.

In accordance with the inventive configurational details discussed hereinabove, the overall hull 12 essentially describes three basic components, viz., a port stabilizer 70, a starboard stabilizer 72 and a main hull 74. Side stabilizers 70 and 72 are located in back section 16 of hull 12. Port stabilizer 70 includes port outer tumblehome surface 30, port connective surface 38, port transom surface portion 56 and starboard transom surface portion 58. Starboard stabilizer 72 includes starboard outer tumblehome surface 32 and starboard connective surface 40. Main hull 74, which is located both in front section 14 and back section 16 of hull 12, includes port inner tumblehome surface 34, starboard inner tumblehome surface 36, medial transom surface portion 60 and under surface 44. Under surface 44 is located both in front section and back section 16 of hull 12. From a bottom (underneath) planwise perspective, the portion of under surface 44 which is in front section 14 approximately describes a triangular outline; the portion of under surface 44 which is in back section 16 approximately describes a regular trapezoidal outline. Above surface 58, shown in FIG. 4 and FIG. 5, is seen to subsume both the centric main hull 74 and the lateral stabilizers 70 and 72.

As best shown in FIG. 2, FIG. 5 and FIG. 6, lower outer tumblehome edges 46 and 48 are not only approximately parallel to each other but are also approximately even horizontally with substantially flat under surface 44 and with each other. That is, substantially flat under surface 44 (or at least the portion thereof in back section 16) generally defines a horizontal plane, and lower outer tumblehome edges 46 and 48 and lower transom edge 54 are approximately coplanar in this horizontal plane. Some inventive embodiments provide for lower outer tumblehome edges 46 and 48 which, though horizontally coplanar with each other, are situated in a vertically different horizontal level from that in which lower transom edge 54 is situated or from that which is described by a substantially flat under surface 44. As shown in FIG. 7, substantially curved under surface 44 is connected to transom 42 such that lower transom edge 54 approximately is horizontally coplanar with lower outer tumblehome edges 46 and 48, while under surface 44 curves below this level forward of transom 42. Regardless of whether under surface 44 is substantially flat or substantially curved, in inventive practice lower outer tumblehome edges 46 and 48 will themselves preferably lie in parallel fashion in approximately the same horizontal plane; however, the disposition of such horizontal plane in relation to lower transom edge 54 or under surface 44 can be coincident or noncoincident, depending on the inventive embodiment.

Side stabilizers 70 and 72, which are each generally characterized by an upwardly inward slope, according to many inventive embodiments constitute only about five to ten percent of the hull 12 (e.g., ship) displacement. However, side stabilizers 70 and 72 provide a significant increase in water plane area and righting moment as soon as hull 12 (e.g., ship) rolls, thus providing for enhanced stability.

In addition, the static water plane moment of inertia is greatly increased by stabilizers 70 and 72, thus providing stability that enables a reduced transom width, e.g., a reduced width of medial transom surface portion 60 of main hull 74. Stabilizers 70 and 72 "hide" the main hull 74 knuckle associated with the reduced transom width of the main hull. The reduced main hull transom width results in less volume above the "designed water line" ("DWL") at the stern (e.g., stern 15) of the vessel (e.g., hull 12). Excessive volume in this region of the vessel is thought to contribute to undesirable sea keeping. As distinguished from the inventive tumblehome design, conventional tumblehome designs are deficient in terms of their ability to provide a restoring moment. When stern quartering waves lift up the stern of a conventional tumblehome vessel, the conventional tumblehome vessel's bow has little ability to provide a restoring moment; that is, the conventional tumblehome vessel's bow digs in and the hull broaches as a result.

According to typical embodiments of the present invention, the outsides of the main hull and the outsides of the stabilizers are at about the same tumblehome slope in order to facilitate the blending of the stabilizers with the main hull at the two (port and starboard) lengthwise commensurate junctional locations (e.g., break points 20 and 22 shown in FIG. 1 and FIG. 2) in back of or behind the bow. For instance, outer tumblehome surfaces 30 and 32 generally are sloped at angle $\alpha$. At least in the vicinity of break points 20 and 22, front port tumblehome surface 24 and front starboard tumblehome surface 26 are each also sloped approximately at angle $\alpha$. As illustrated in FIG. 6 or FIG. 7 considered in conjunction with FIG. 1 or FIG. 2, break points 20 and 22 roughly correspond to station 6 of a twenty-station ship.

In inventive practice, there will be some small additional hull weight associated with the side stabilizers (e.g., stabilizers 50 and 52); however, this additional weight is much less than that associated with conventional trimaran side hulls (outriggers). The bending moment associated with conventional trimaran-type outriggers is avoided by the present invention.

As exemplified by above surface 58 of hull 12 in FIG. 4 and FIG. 5, the width at the top deck of an inventive vessel is significantly increased in comparison with conventional vessels. This inventive increase in width will promote and increase arrangement flexibility and load capacity. Furthermore, this inventive width increase will provide additional damage stability, and will provide stability at large heel angles.

Figure 8:
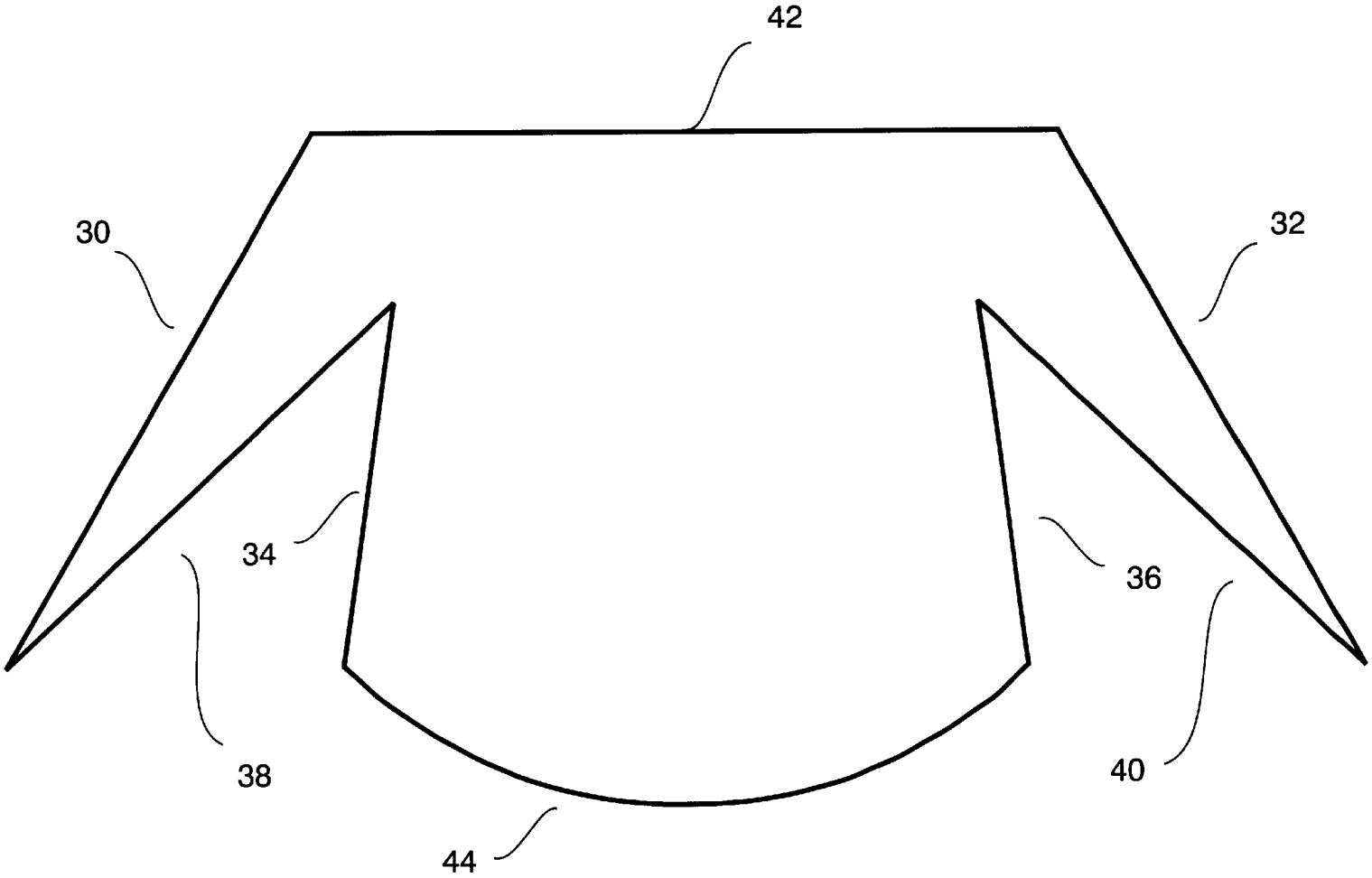
FIG. 8 and FIG. 9 are diagrammatic rear elevation views of different inventive hullform embodiments wherein the hullform is characterized by tumblehome inner side surfaces.
Figure 9:
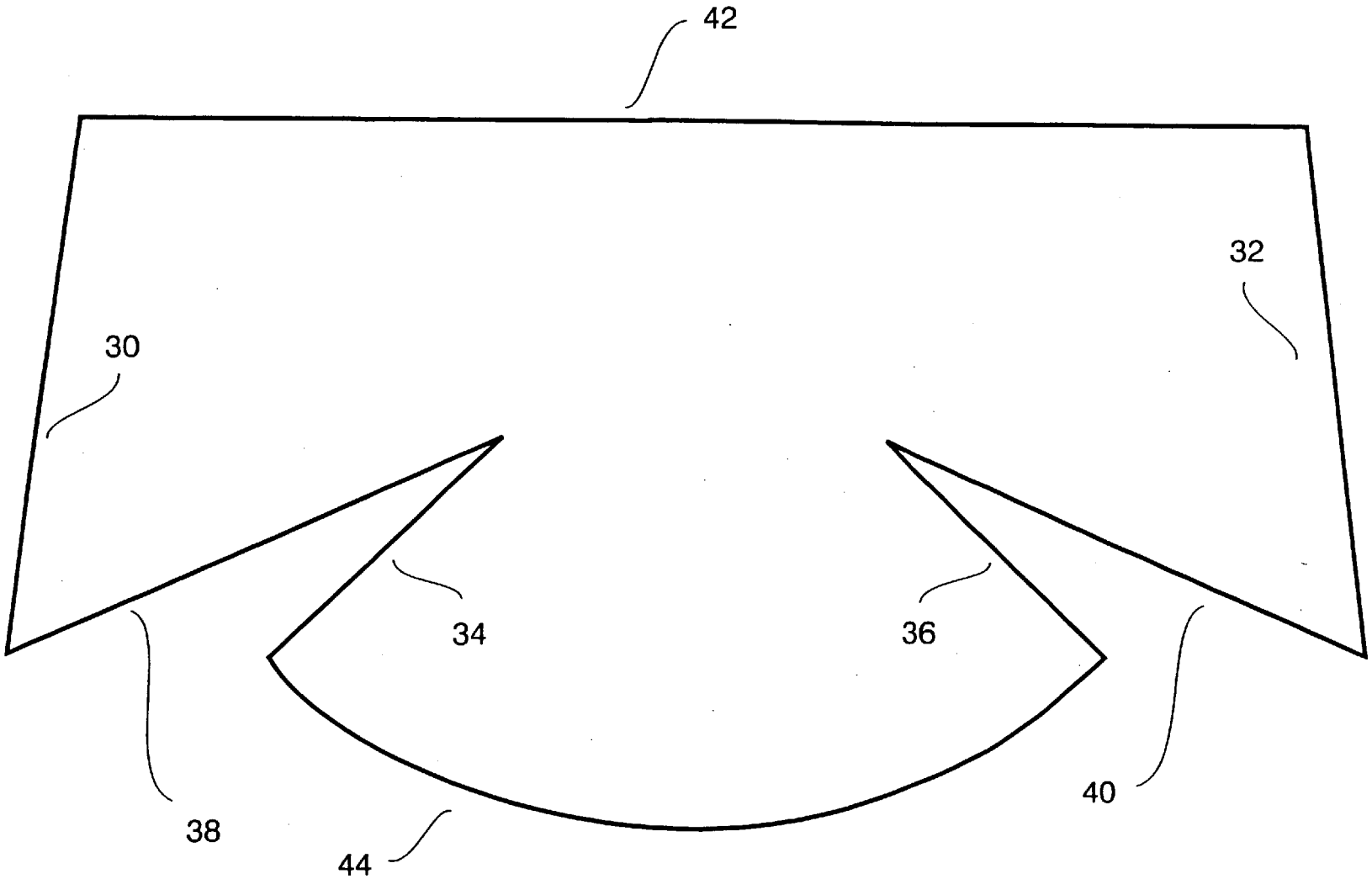
Figure 10:
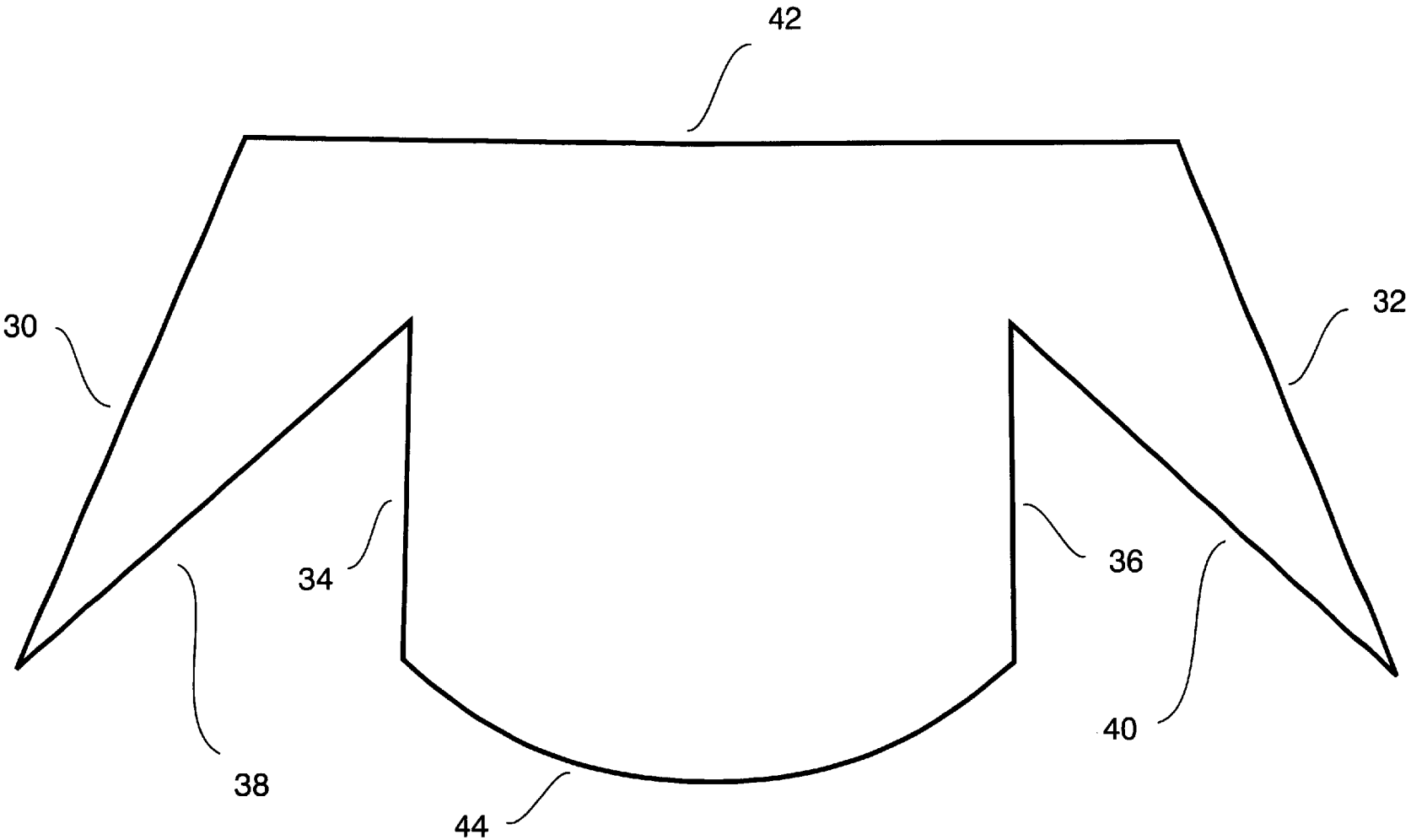
FIG. 10 and FIG. 11 are diagrammatic rear elevation views of different inventive hullform embodiments wherein the hullform is characterized by non-tumblehome, vertical inner side surfaces.
Figure 11:
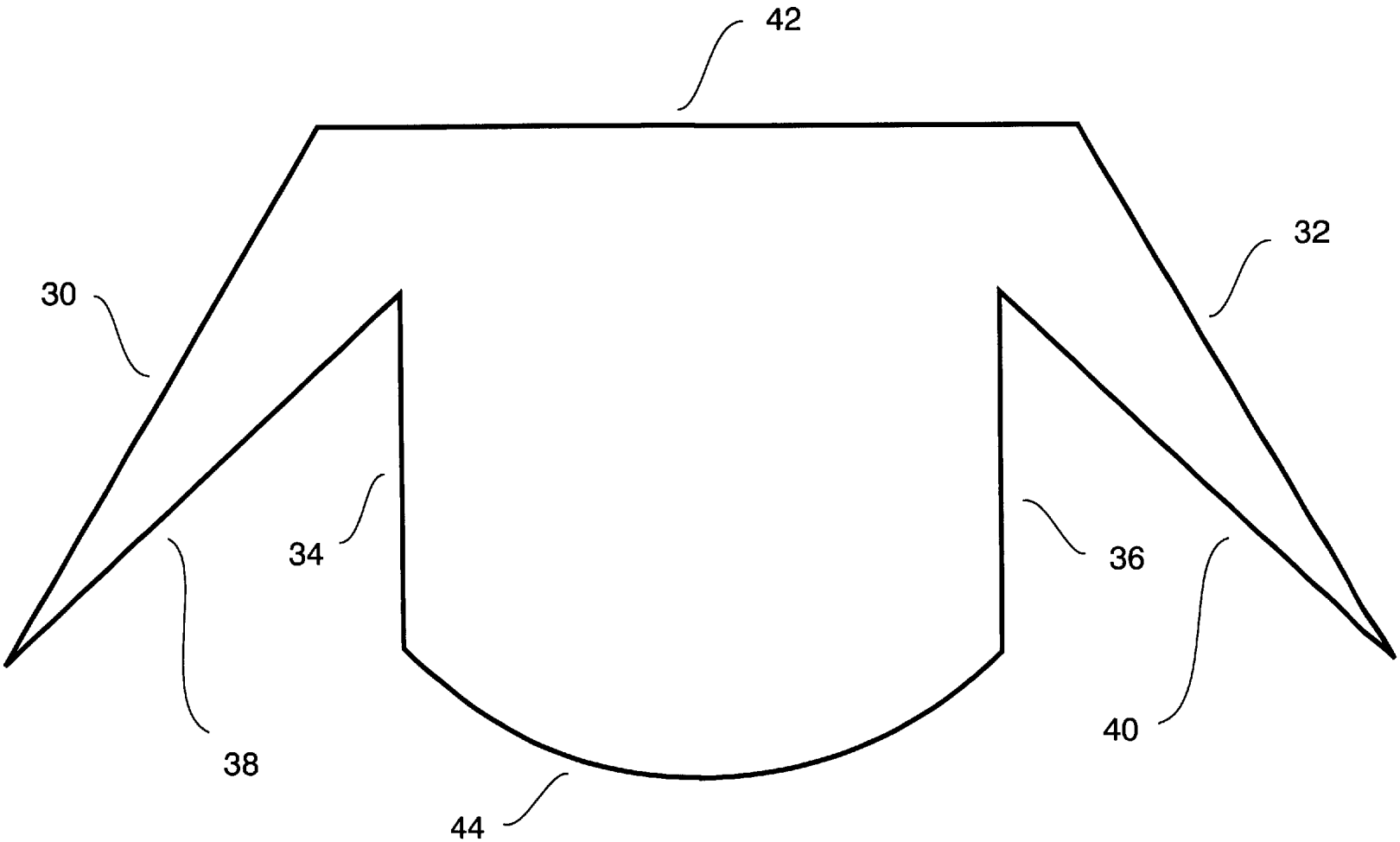
Figure 12:
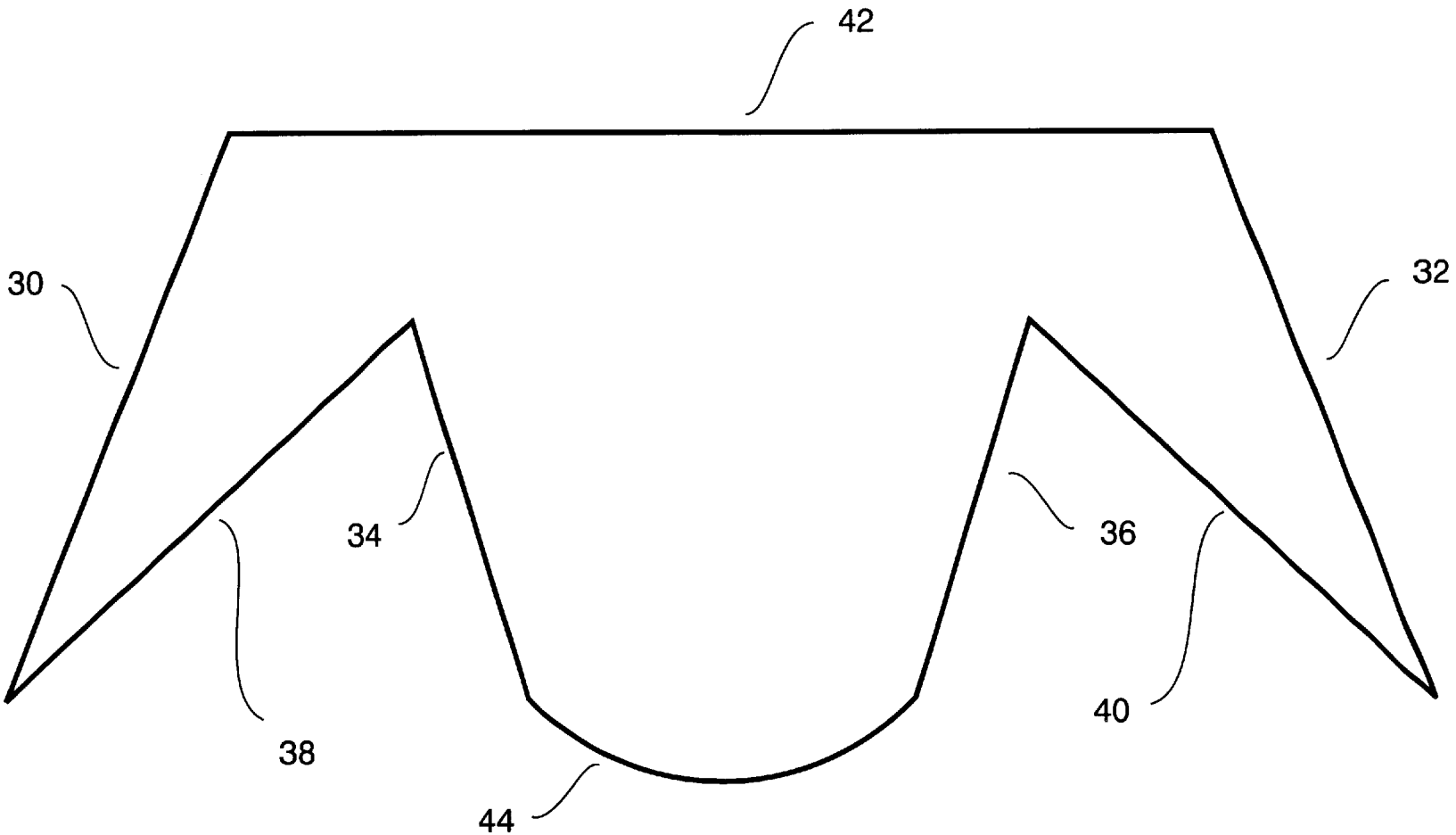
FIG. 12 through FIG. 15 are diagrammatic rear elevation views of different inventive hullform embodiments wherein the hullform is characterized by non-tumblehome, nonvertical inner side surfaces.
Figure 13:
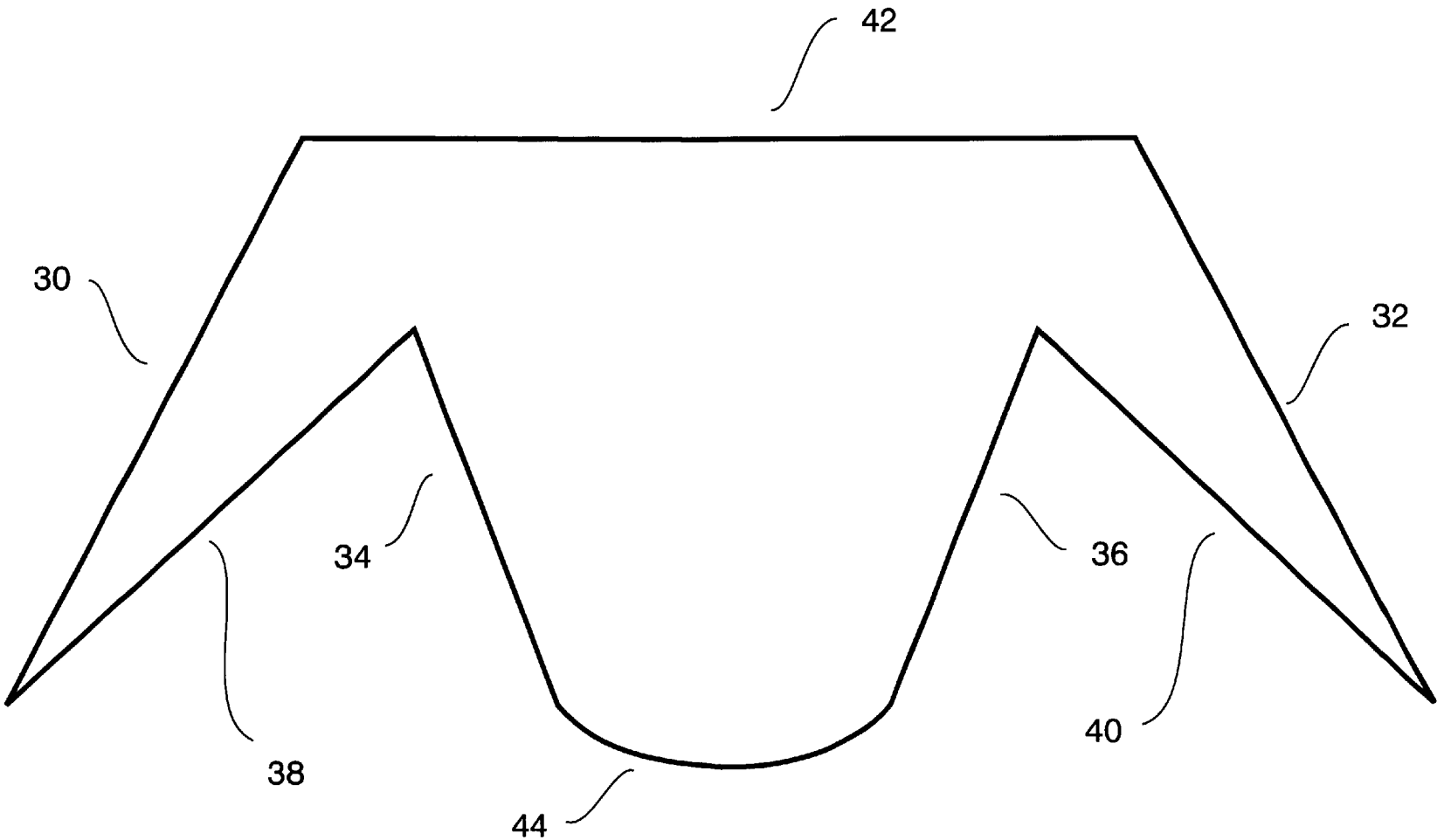
Figure 14:
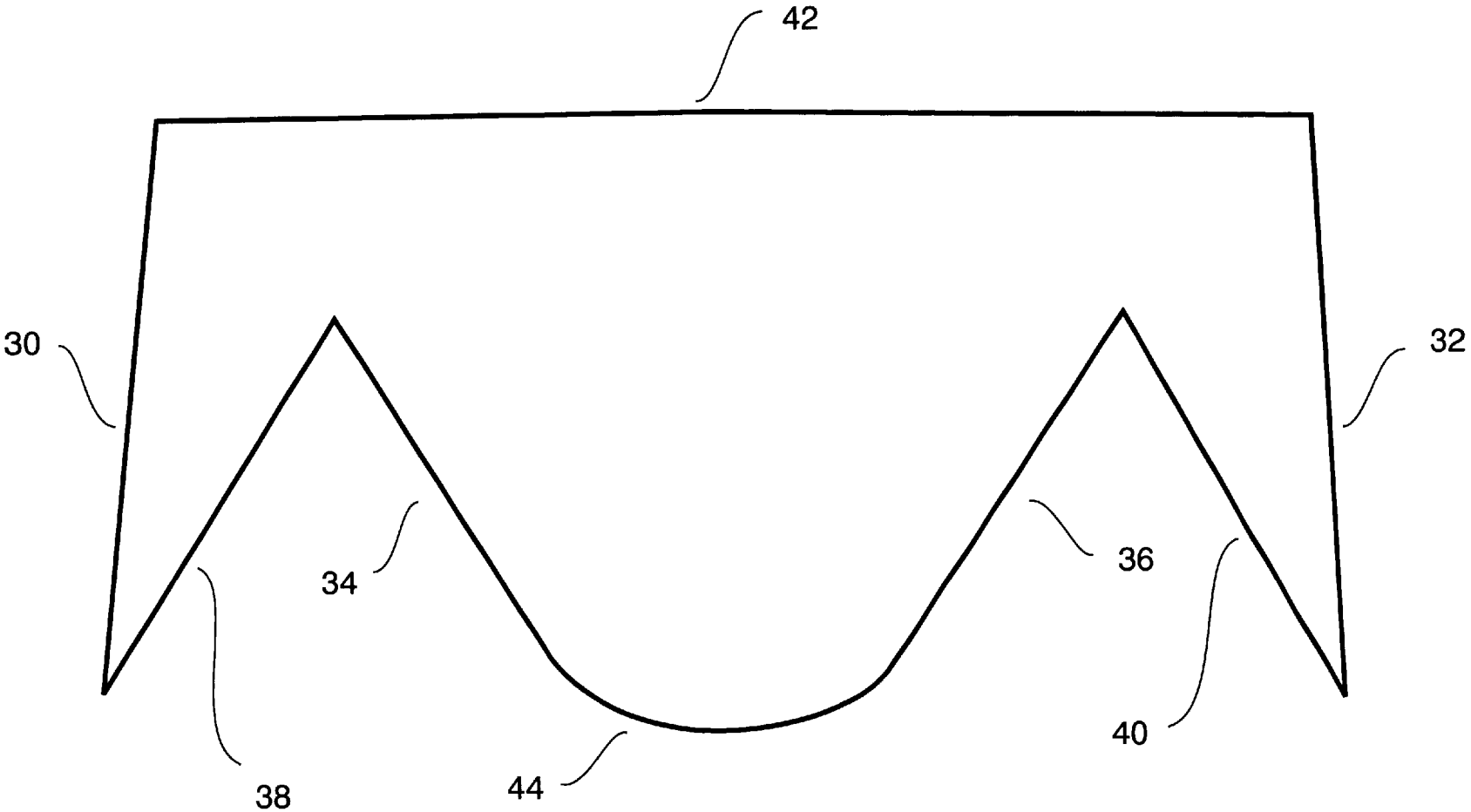
Figure 15:
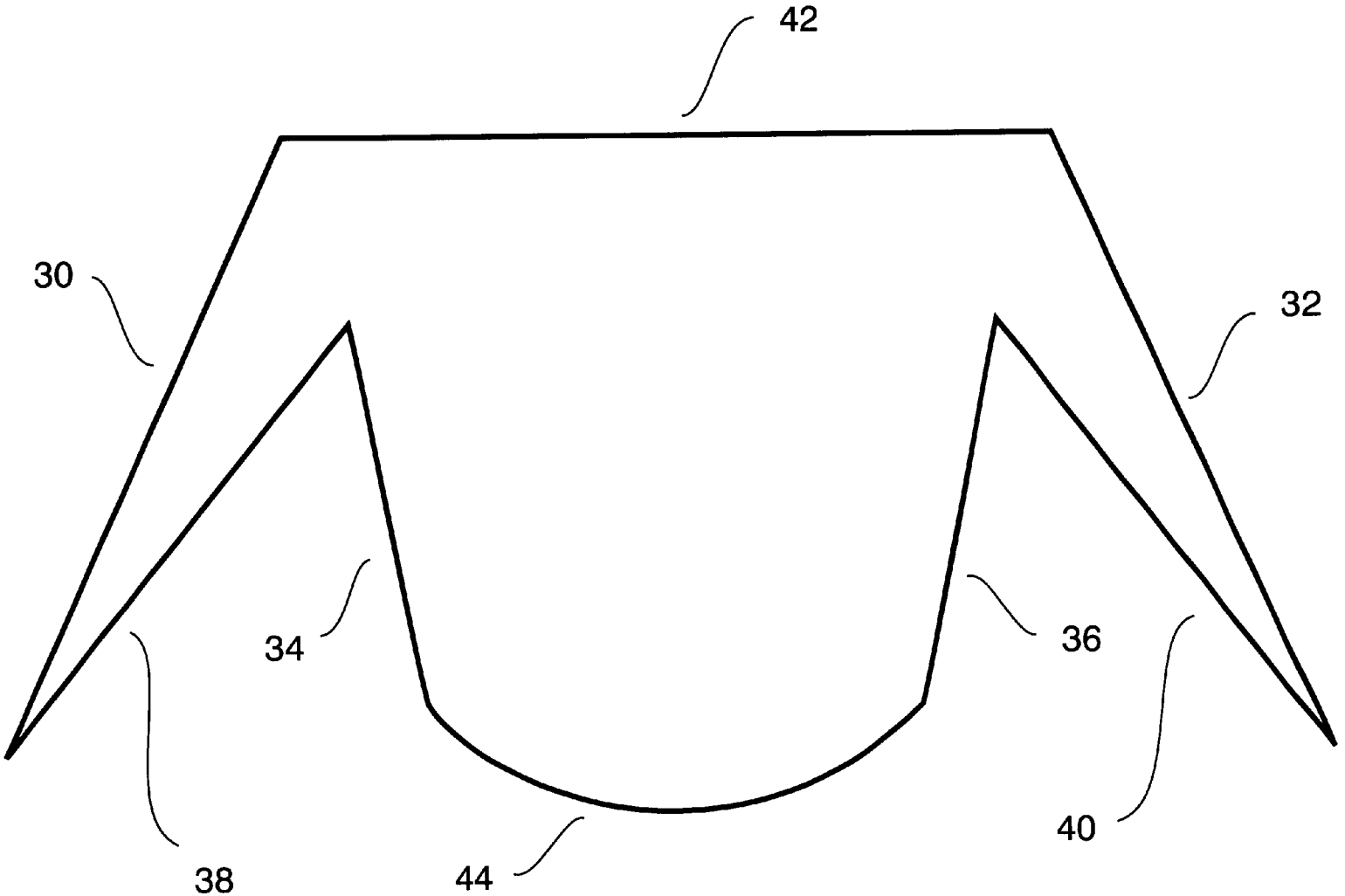

Now referring to FIG. 8 through FIG. 15, some inventive embodiments provide inner surfaces 34 and 36 which are: (i) tumblehome surfaces (such as shown in FIG. 8 and FIG. 9); or, (ii) non-tumblehome, vertical surfaces (such as shown in FIG. 10 and FIG. 11); or, non-tumblehome, non-vertical surfaces (such as shown in FIG. 12 through FIG. 15). In each of FIG. 8 through FIG. 15, hull 12 has: a port tumblehome outer surface 30; a starboard tumblehome outer surface 32; a port inner surface 34 which (depending on the figure) is either a tumblehome surface or a non-tumblehome surface; a starboard inner surface 36 which (depending on the figure) is either a tumblehome surface or a non-tumblehome surface; a port connective surface 38; a starboard connective surface 40; a stern 15 rectilinear transom surface 42; and, a curved undersurface 44. Not only inner surfaces 34 and 36, but also tumblehome outer surfaces 30 and 32, are variously slanted in FIG. 8 through FIG. 15.

As shown in FIG. 8 and FIG. 9, port inner surface 34 and starboard inner surface 36 are each slanted in tumblehome fashion, similarly as illustrated in prior figures; however, the hullforms 12 shown in FIG. 8 and FIG. 9 are configurationally distinguishable therefrom and from each other. FIG. 10 through FIG. 15 depict various tumblehome modes of outer surfaces 30 and 32, and various non-tumblehome modes of inner surfaces 34 and 36. As shown in FIG. 10 and FIG. 11, non-tumblehome port inner surface 34 and non-tumblehome starboard inner surface 36 are each approximately vertical. As shown in FIG. 11 through FIG. 15, non-tumblehome port inner surface 34 and non-tumblehome starboard inner surface 36 are each non-vertical.

A possible advantage of providing a tumblehome port inner surface 34 and a tumblehome starboard inner surface 36, as distinguished from non-tumblehome inner surfaces 34 and 36, is that it facilitates the port and starboard fairings located in the vicinity of port and starboard break points 20 and 22, respectively, which are the port and starboard forward ends of the port and starboard "furrows," respectively. Nevertheless, it is to be emphasized that inventive practice does not dictate that inner surfaces 34 and 36 be tumblehome surfaces. Many inventive embodiments provide inner surfaces 34 and 36 which are not tumblehome surfaces.

According to this invention, inner surfaces 34 and 36 can be slanted practically any which way. Similarly, port and starboard front surfaces 24 and 26 can be slanted practically any which way. Connective surfaces 38 and 40 can be slanted practically any which way, so long as connective surfaces 38 and 40 are slanted in appropriately connective fashion. Outer surfaces 30 and 32 can be slanted practically any which way, so long as outer surfaces 30 and 32 are slanted in tumblehome fashion.

Furthermore, inner surfaces 34 and 36, and/or connective surfaces 38 and 40, and/or front surfaces 24 and 26, and/or front tip 28, and/or under surface 44, and/or stern 42 (e.g., transom surface 42) can be flat, curved, straight, rounded or some combination thereof. According to typical inventive practice, the tumblehome outside surfaces 30 and 32 will be at least substantially characterized by linearity or flatness, but can to some degree be characterized by curvilinearity or curvature. Moreover, the hull's top side can be "closed," "open" or some combination thereof. In addition, in terms of shapes and orientations, inventive principles do not necessarily require either similarity or dissimilarity, vis-a-vis' each other, between and among: inner surfaces 34 and 36; front surfaces 24 and 26; tip 28; tumblehome outer surfaces 30 and 32; stern (transom) 42; and, under surface 44.

In accordance with the present invention, there is practically a limitless diversity of possible combinations of the vertical angles described by the port and starboard tumblehome outer surfaces (e.g., angles $\alpha$, the port and starboard inner surfaces (e.g., angles $\beta$), the port and starboard connective surfaces (e.g., angles $\phi$), and the port and starboard front surfaces 24 and 26. According to inventive principles, port and starboard outer surfaces are tumblehome surfaces; port and starboard inner surfaces can be tumblehome or non-tumblehome surfaces; further, port and starboard front surfaces 24 and 26 can be tumblehome or non-tumblehome surfaces.

Regardless of the specific shapes and angularities and the overall configuration of the inventive hullform, An important aspect of the present invention is that the port and starboard configurations are such as to afford a kind of stability analogous to that associated with a conventional trimaran vessel, as well as a kind of tumblehome hull shape analogous to that associated with a conventional tumblehome hull. In accordance with the present invention, the port and starboard configurations, correspondingly associated with the port and starboard tumblehome outer surfaces, afford trimaran-like stability without resorting to outriggers that protrude from the hull; the additional stability allows for a tumblehome-type hull form.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. A water vehicle such as a water transportation vehicle, said water vehicle having a length, an imaginary lengthwise axis, a port side and a starboard side, said water vehicle being about equivalently configured on each said side of said water vehicle, wherein on each said side of said water vehicle:

said water vehicle comprises a tumblehome outer surface, an inner surface and a junctional surface;

said inner surface generally is located more proximate said lengthwise axis than said tumblehome outer surface;

said junctional surface joins each of said tumblehome outer surface and said inner surface so as to generally be interposed between said tumblehome outer surface and said inner surface;

said inner surface is a tumblehome inner surface; and relative to horizontality, said tumblehome outer surface and said tumblehome inner surface are about equivalently sloped.

2. A water vehicle such as a water transportation vehicle, said water vehicle having a length, an imaginary lengthwise axis, a port side, a starboard side, a bow and a stern, said water vehicle being about equivalently configured on each said side of said water vehicle, wherein on each said side of said water vehicle:

said water vehicle comprises a tumblehome outer surface, an inner surface and a junctional surface;

said inner surface generally is located more proximate said lengthwise axis than said tumblehome outer surface;

said junctional surface joins each of said tumblehome outer surface and said inner surface so as to generally be interposed between said tumblehome outer surface and said inner surface;

relative to said lengthwise axis, said tumblehome outer surface and said inner surface each extend from about said stern to about the same intermediate lengthwise position of said water vehicle;

said intermediate lengthwise position is forward of said stern and aft of said bow;

said exterior juncture is about parallel to said lengthwise axis;

said interior juncture is nonparallel to said lengthwise axis; and horizontally considered, said interior junction slants toward said lengthwise axis in the aftward direction.

3. A hull comprising a pair of lateral fins and a medial portion between said lateral fins, said lateral fins being integrally associated with said medial portion, each said lateral fin including a lateral tumblehome face, said hull including a back section of said hull, and a front section of said hull; said hull being characterized by a length and by an imaginary horizontal plane passing through said hull; said back section including said lateral fins and said medial portion; said medial portion including a pair of medial faces; each said lateral fin including a crosswise face; each said crosswise face and a said lateral tumblehome face forming therebetween an at least substantially horizontal fin edge; each said crosswise face and a said medial face forming therebetween an at least substantially horizontal junctional corner; each said crosswise face being at least substantially sloped at an angle with respect to said imaginary horizontal plane which, to at least a substantial degree, gradually increases in accordance with the forward lengthwise direction of said hull; said hull being characterized an imaginary lengthwise medial vertical plane passing through said hull; each said crosswise face at least substantially being sloped at an angle with respect to said imaginary lengthwise medial vertical plane which, to at least a substantial degree, gradually increases in accordance with the forward direction of said imaginary lengthwise medial vertical plane; said fin edges being at least substantially parallel to each other; said fin edges, at least to a substantial degree, being situated at about the same fin edge height.

4. A hull as recited inclaim 3, wherein:

said back section generally describes a rectangular top-perspective plan outline;

said front section generally describes a triangular top-perspective plan outline which narrows frontward;

said lateral fins are a starboard fin and a port fin;

said lateral fins and said medial portion generally describe therebetween a pair of furrows;

said furrows are a starboard furrow and a port furrow;

each said lateral fin generally describes a downwardly pointing wedge-shaped back-perspective profile;

each said furrow generally describes an upwardly pointing notch-shaped back-perspective profile;

said back section represents at least half the length of said hull;

said front section includes a pair of front faces;

said front faces and said lateral tumblehome faces at least substantially reach the same first vertically upper extreme height; and said medial faces at least substantially reach a second vertically upper extreme height which, at least to a substantial degree, is lower than said first vertically upper extreme height.

5. A hull as recited in claim 3, wherein:

said back section includes an at least substantially rectilinear stern which describes a lower transom edge; and said lower transom edge and said fin edges, to at least a substantial degree, are situated at about the same fin edge height.

6. A hull as recited in claim 5, wherein:

said medial portion includes a medial bottom side;

said medial bottom side and said rectilinear stern meet at said lower transom edge;

said medial bottom side generally describes a regular trapezoidal outline which narrows backward; and generally, during straight-course navigation of said hull, said lower transom edge, said fin edges and said medial bottom side, to at least a substantial degree, are at least slightly submerged.

7. A hull as recited in claim 3, wherein:

said medial faces are medial tumblehome faces;

said medial portion generally describes a regular trapezoidal back-perspective profile which narrows upward;

each said crosswise face at least substantially is sloped at a smaller angle with respect to said imaginary horizontal plane than are said medial tumblehome faces and said lateral tumblehome faces; and each said crosswise face at least substantially is sloped at a greater angle with respect to said imaginary lengthwise medial vertical plane than are said medial tumblehome faces and said lateral tumblehome faces.

8. A hull as recited in claim 3, wherein:

said medial faces are medial tumblehome faces;

said medial tumblehome faces and said lateral tumblehome faces, to at least a substantial degree, are sloped at at about the same at least substantially constant angle with respect to said imaginary lengthwise medial vertical plane;

said front faces are front tumblehome faces; and said front tumblehome faces, said medial tumblehome faces and said lateral tumblehome faces, to at least a substantial degree, are sloped at about the same at least substantially constant angle with respect to said imaginary lengthwise medial vertical plane.

9. A marine vessel comprising a hull having, on opposite port-starboard sides of said hull, a pair of inner surfaces, a pair of tumblehome outer surfaces and a pair of inner-outer connective surfaces, said inner surfaces and said inner-outer connective surfaces together defining a pair of downwardly divergently acutely angular grooves on said opposite sides; said outer tumblehome surfaces and said inner-outer connective surfaces together defining a pair of upwardly divergently acutely angular structures on said opposite sides; said grooves and said structures being approximately coextensive longitudinally from the stern of said hull to a pair of approximately equivalent junctional locations; said grooves and said structures tapering in the longitudinally forward direction from said stern to said locations; said tumblehome outer surfaces approximately defining respective outer tumblehome axes which are approximately parallel in relation to each other; said inner surfaces approximately defining respective inner axes which are approximately coplanar and oblique in relation to each other, said inner axes diverging in said longitudinally forward direction; wherein, on each said side, the corresponding said tumblehome outer surface, the corresponding said inner-outer connective surface and the corresponding said inner surface converge in the approximate vicinity of the corresponding said junctional location.

10. The marine vessel according to claim 9, wherein:

said junctional locations are behind the longitudinally forwardmost point of said hull in the longitudinally forward half of said hull;

said tumblehome outer surfaces are approximately coextensive vertically to a first horizontal level which is proximate the top of said hull;

said inner surfaces are approximately coextensive vertically to a second horizontal level which is below said first horizontal level;

said tumblehome outer surfaces are disposed at approximately equal, opposite and constant angles in relation to an imaginary planar longitudinal bisector through said hull;

said inner surfaces are disposed at approximately equal, opposite and constant angles in relation to said imaginary bisector;

said inner-outer connective surfaces meet said inner surfaces approximately at said second horizontal level; and said inner-outer connective surfaces are disposed at approximately equal and opposite nonconstant angles in relation to said imaginary bisector; and in relation to said imaginary bisector, said nonconstant angles decrease in said longitudinally forward direction.

11. A hull configuration having an imaginary centerline and comprising a stern surface, an outer starboard tumblehome surface, an inner starboard surface, an outer port tumblehome surface, an inner port surface, a starboard obliquely downfacing surface and a port obliquely downfacing surface, wherein:

said outer starboard tumblehome surface, said inner starboard surface, said outer port tumblehome surface, said inner port surface, said starboard obliquely downfacing surface and said port obliquely downfacing surface each extend from said stern surface in a generally forward direction;

said starboard obliquely downfacing surface connects said outer starboard tumblehome and said inner starboard surface;

said port obliquely downfacing surface connects said outer port tumblehome surface and said inner port surface;

said outer starboard tumblehome surface and said outer port tumblehome surface are each approximately parallel to said centerline;

proceeding from said stern surface in a generally forward direction, said inner starboard surface and said inner port surface diverge from said centerline in approximately equivalent fashion;

said hull configuration comprises an approximately horizontally downfacing surface which approximately describes a regular trapezoidal shape and which is approximately symmetrical with respect to said centerline; and said approximately horizontally downfacing surface connects said inner starboard surface and said inner port surface.

12. A hull configuration having an imaginary centerline and comprising a stern surface, an outer starboard tumblehome surface, an inner starboard surface, an outer port tumblehome surface, an inner port surface, a starboard obliquely downfacing surface and a port obliquely downfacing surface, wherein:

said outer starboard tumblehome surface, said inner starboard surface, said outer port tumblehome surface, said inner port surface, said starboard obliquely downfacing surface and said port obliquely downfacing surface each extend from said stern surface in a generally forward direction;

said starboard obliquely downfacing surface connects said outer starboard tumblehome and said inner starboard surface;

said port obliquely downfacing surface connects said outer port tumblehome surface and said inner port surface;

said outer starboard tumblehome surface and said outer port tumblehome surface are each approximately parallel to said centerline;

proceeding from said stern surface in a generally forward direction, said inner starboard surface and said inner port surface diverge from said centerline in approximately equivalent fashion;

said inner starboard surface is an inner tumblehome starboard surface;

said inner port surface is an inner tumblehome port surface;

said outer starboard tumblehome surface, said starboard obliquely downfacing surface and said inner starboard tumblehome surface define, from an aft perspective, an approximate N-shaped starboard profile wherein said outer starboard tumblehome surface reaches a greater elevation than does said inner starboard tumblehome surface;

said outer port tumblehome surface, said port obliquely downfacing surface and said inner port tumblehome surface define, from an aft perspective, an approximate reverse N-shaped port profile wherein said outer port tumblehome surface reaches a greater elevation than does said inner port tumblehome surface; and proceeding from said stern surface in a generally forward direction, said N-shaped starboard profile and said reverse N-shaped port profile each narrow in breadth in approximately equivalent fashion.

13. A hull configuration having an imaginary centerline and comprising a stern surface, an outer starboard tumblehome surface, an inner starboard surface, an outer port tumblehome surface, an inner port surface, a starboard obliquely downfacing surface and a port obliquely downfacing surface, wherein:

said outer starboard tumblehome surface, said inner starboard surface, said outer port tumblehome surface, said inner port surface, said starboard obliquely downfacing surface and said port obliquely downfacing surface each extend from said stern surface in a generally forward direction;

said starboard obliquely downfacing surface connects said outer starboard tumblehome and said inner starboard surface;

said port obliquely downfacing surface connects said outer port tumblehome surface and said inner port surface;

said outer starboard tumblehome surface and said outer port tumblehome surface are each approximately parallel to said centerline;

proceeding from said stern surface in a generally forward direction, said inner starboard surface and said inner port surface diverge from said centerline in approximately equivalent fashion; and said outer starboard tumblehome, said inner starboard tumblehome, said outer port tumblehome and said inner port tumblehome each define approximately the same tumblehome angle.

14. A marine hull which is approximately characterized by a lengthwise axis, said hull comprising:

two stabilizers, each said stabilizer extending from stern to afore-midship, one said stabilizer being situated port, the other said stabilizer being situated starboard, each said stabilizer including an approximately planar outward facing stabilizer side and an approximately planar inward facing stabilizer side and an approximately horizontal exterior edge, said outward facing stabilizer side and said inward facing stabilizer side being acutely inclined with respect to each other and joining at said exterior edge, said exterior edges being approximately parallel to each other and said longitudinal axis, said outward facing stabilizer sides being inclined downwardly-outwardly at approximately equal, approximately constant and approximately opposite first, non-vertical inclinations, said inward facing stabilizer sides being inclined downwardly-outwardly at approximately equal, approximately variable and approximately opposite second, non-vertical inclinations; and a main body section intermediate said stabilizers, said main body section including an aft main body side and two approximately planar outward facing main body sides, one said outward facing main body side being situated port, the other said outward facing main body side being situated starboard, each said outward facing main body side being acutely inclined with respect to a said inward facing stabilizer side and joining said inward facing stabilizer side at an approximately horizontal interior edge, said interior edges being approximately horizontal and approximately convergent toward said aft main body side, said outward facing stabilizer sides being inclined at approximately equal, approximately constant and approximately opposite third inclinations, said third inclinations being approximately unequal to said first inclinations and said second inclinations.

15. A water vehicle conceivably having a vertical centerline plane, said water vehicle comprising:

on its starboard- and port sides, two stabilization flotation members, each said stabilization flotation member generally defining a V-shaped cross-section, each said stabilization flotation member having an outer member side and an inner member side, said outer member sides generally facing away from said vertical centerline plane, said inner member sides generally facing toward said vertical centerline plane, said outer member sides each being generally parallel in relation to said vertical centerline plane and slanting upwardly and inwardly at approximately equal opposite outside inclinations in relation to said vertical centerline plane, said inner member sides each being generally oblique in relation to said vertical centerline plane and slanting upwardly and inwardly at approximately equal opposite inside member inclinations in relation to said vertical centerline plane, said outside member inclinations each being generally unvarying in relation to said vertical centerline plane, said outside member inclinations generally being steeper than said inside member inclinations in relation to said vertical centerline plane, said inside member inclinations each generally steepening in relation to said vertical centerline plane as a function of distance in the forward direction; and intermediate said stabilization flotation members, a hull structure, said hull structure having two structure sides and a structure underside, said structure sides generally facing away from said vertical centerline plane, said structure underside generally being bisected by said vertical centerline plane, said structure sides each being generally nonparallel in relation to said vertical centerline plane and being disposed at approximately equal opposite structure inclinations in relation to said vertical centerline plane said, structure inclinations each being generally unvarying in relation to said vertical centerline plane, said structure sides each generally decreasing in distance in relation to said vertical centerline plane as a function of distance in the forward direction.

16. The water vehicle according to claim 15, wherein:

said outer member sides, said inner member sides and said structure sides are each generally planar;

on its starboard side, the corresponding said inner member side and the corresponding said structure side meet at a starboard junction which generally defines a horizontal linear starboard junction;

on its port side, the corresponding said inner member side and the corresponding said structure side meet at a port junction which generally defines a horizontal linear port junction;

said starboard junction and said port junction:

are approximately parallel to each other;

are at approximately the same elevation in relation to said vertical centerline plane; and slant inwardly at approximately equal opposite junctional inclinations in relation to said vertical centerline plane.

17. The water vehicle according to claim 15, wherein said structure inclinations, in relation to said vertical centerline plane, are such that said structure sides are each generally oblique in relation to said vertical centerline plane and slant upwardly and inwardly in relation to said vertical centerline plane.

18. The water vehicle according to claim 15, wherein said structure inclinations, in relation to said vertical centerline plane, are such that said structure sides are each generally oblique in relation to said vertical centerline plane and slant downwardly and inwardly in relation to said vertical centerline plane.

19. The water vehicle according to claim 15, wherein said structure inclinations, in relation to said vertical centerline plane, are such that said structure sides are each generally parallel in relation to said vertical centerline plane.

* * * * *